United States Patent [19]

Cook et al.

[11] Patent Number: 4,978,284

[45] Date of Patent: Dec. 18, 1990

[54] DOUBLE ACTING SIMPLEX PLUNGER PUMP

[76] Inventors: James E. Cook, 418 Rice St., Anoka, Minn. 55303; O. Harald S. Eriksen, 6219 Zealand Ave. North, Brooklyn Park, Minn. 55428

[21] Appl. No.: 487,186

[22] Filed: Mar. 1, 1990

[51] Int. Cl.[5] ..... F04B 19/02

[52] U.S. Cl. ..... 417/534; 417/415

[58] Field of Search ..... 417/415, 418, 534–536

[56] References Cited

U.S. PATENT DOCUMENTS 2,871,795 2/1959 Smith ..... 417/534

3,233,554 2/1966 Huber et al. ..... 417/534 X 4,443,163 4/1984 Gaither ..... 417/534 X 4,824,335 4/1989 Lubitz et al. ..... 417/418 X

*Primary Examiner*—John C. Fox

*Attorney, Agent, or Firm*—Roger W. Jensen

[57] ABSTRACT

A double acting simplex plunger pump comprising six unitary extruded members, i.e., a crankcase body, a manifold connected thereto and, at each end of the body a stuffing box member abutted on one face to the body and, on the opposite face, to a head member. The pump also comprises a double ended plunger supported by the body for reciprocation of the ends thereof into pump recesses of the stuffing box members.

18 Claims, 6 Drawing Sheets

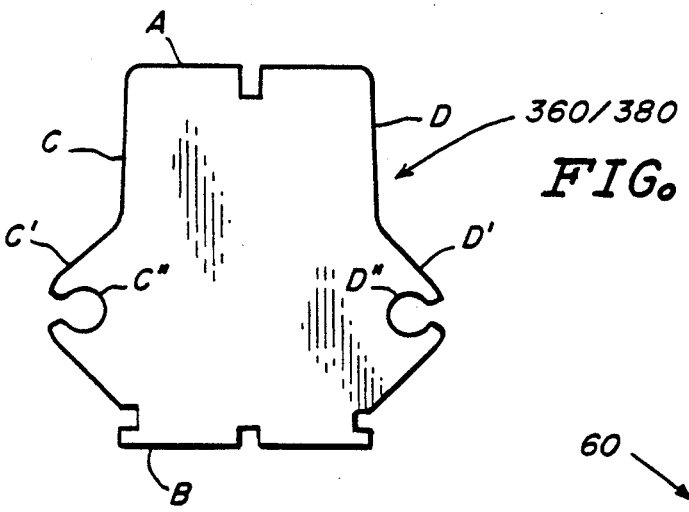
FIG. 10
FIG. 11
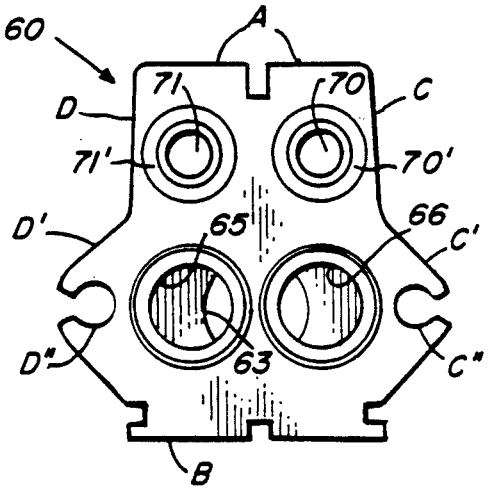
FIG. 13
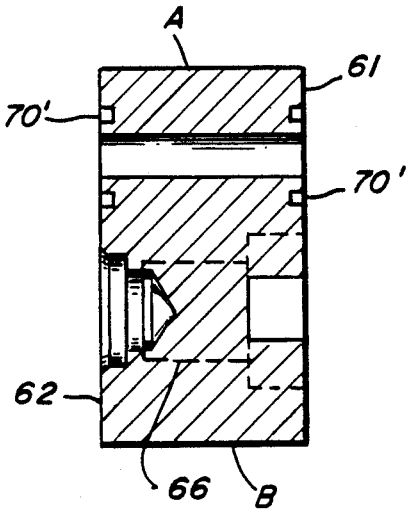
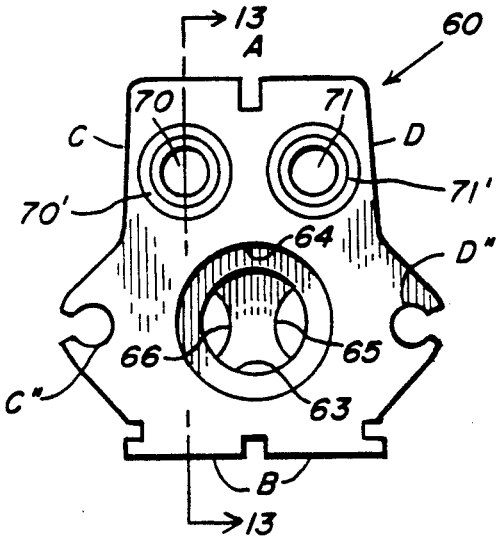
FIG. 12

FIG. 15
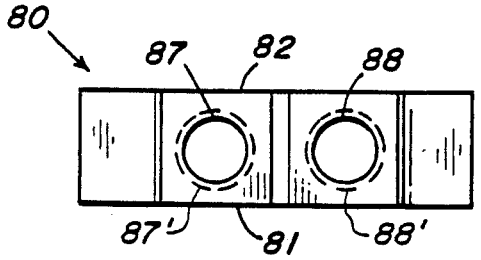
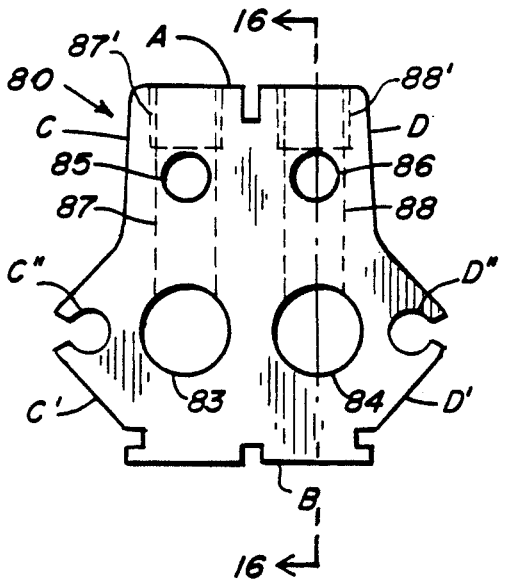
FIG. 14
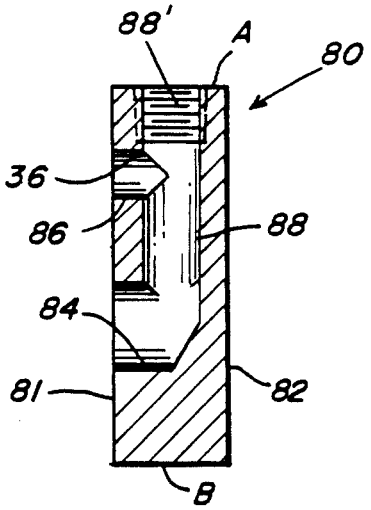
FIG. 16
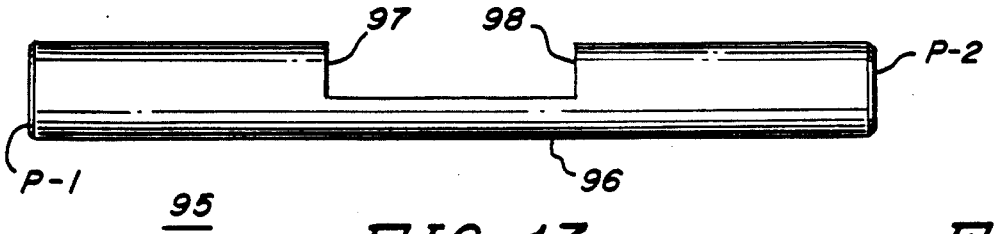
FIG. 17
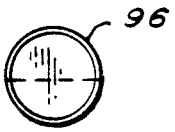
FIG. 18

DOUBLE ACTING SIMPLEX PLUNGER PUMP

BACKGROUND OF THE INVENTION

This invention pertains to hydraulic pumps; the invention provides an improved pump and an improved method of manufacturing such pumps. More specifically, our invention is generically applicable to double acting simplex plunger pumps which can be grouped into two categories, i.e., "piston" type. A "plunger" type pump comprises in part a solid plunger which moves or reciprocates relative to a stationary seal. A "piston" type pump comprises in part a piston which moves or reciprocates within a cylinder and a piston ring or equivalent sealing means caused by the piston facilitates the sealing and, hence, the pumping action. Our invention is directly applicable to pumps of all pressure ranges from high pressure to low pressure.

An example of a high pressure application of our invention is the following specification: 350 pounds per square inch (PSI) pressure; 0.87 gallon per minute (GPM) flow rate (1 foot suction lift) at 1640 shaft revolutions per minute (R.P.M.), and applied electrical power of only 2.9 amperes at 90 volts; the foregoing very high efficiency unit, with its "low profile" shape or configuration, permits numerous utilizations not heretofore possible. For example a pump with the aforesaid specification may be incorporated into a portable cleaner for rugs, walls, ceilings, etc. wherein the cleaner comprises an electrically powered vacuum means and the total electrical power consumption of the cleaner is within the "normal" 15 ampere limit of a standard U.S. residential electrical power outlet.

An example of a prior art double acting simplex plunger pump is the series 5300 twin piston pump manufactured and sold by Hypro Division of Lear Siegler, Inc. of St. Paul, Minn. Although there are some similarities between the pump provided by our invention and the aforesaid Hypro pumps, there are a number of important differences. In particular the Hypro pump comprises a cast iron body, a relatively complex and expensive casting which includes two integral manifolds. Coacting with the cast iron body are a pair of cylinder heads which also are cast iron. Thus the Hypro unit has a total of three cast iron primary parts intended to coact with an internal double ended piston member driven by a crank on the end of a motor driven shaft.

Our invention has a unitary crankcase, a unitary manifold, two separate and unitary stuffing boxes, and two unitary heads comprising a total of six separate unitary parts adapted to be assembled together into a low profile unit unit for coaction with an internal double ended plunger member adapted to be reciprocated within the unit upon being driven by a crank on the end of a driven shaft. A very important feature of our invention is that the six aforesaid described unitary elements, i.e., the crankcase, manifold, stuffing boxes, and heads all are manufactured from extrusions; more specifically, all are slices taken at right angles to the longitudinal axis of an extrusion. The crankcase, for example, including a crankcase space, is simply and inexpensively defined by cutting a slice, i.e., a transverse cut of an extrusion, the outer configuration of which corresponds to the outer configuration of the crankcase body and with the crankcase space being defined during the extrusion process.

There are, of course, many prior art pumps. Examples include pumps disclosed in Pat. Nos. 4,232,063; 4,153,393; 4,721,444; 4,184,817 and 4,142,839. None of these patents, nor the above identified series 5300 Hypro pumps manufactured, nor any other pumps of which we are aware, provides a pump having the several advantages and unique features of our invention.

SUMMARY OF THE INVENTION

The primary object of the present invention is to provide an improved twin plunger pump characterized by having very high performance and relatively low manufacturing cost, the low cost stemming from the unique design and the use of extrusions for all of the key pump parts except for the plunger member. Our concept of utilizing extrusions, as aforesaid, is unique and the resultant pumps have numerous advantages over the other pumps currently offered. For example our pumps have fewer parts. They are very simple to assemble, to repair, and to modify to a different pressure/flow rate configuration; all of the foregoing being possible very quickly with a single tool, i.e., a hex-head wrench. The inherent nonporosity of an extruded part is another advantage; this precludes a field failure from an undetected "porosity" defect that is frequently encountered in cast parts.

DESCRIPTION OF THE DRAWINGS

FIG. 10 is an end view of the extrusion which is used for both the head and the stuffing box members or elements of the pump, FIGS. 11 and 12 are the outboard end view and the inboard end view respectively of the stuffing box member after being sliced from the extrusion depicted in FIG. 10 and after certain simple machining operations have been performed, FIG. 13 is a cross-section of the apparatus depicted in FIG. 12 as viewed along section line 13—13, FIGS. 14 and 15 are the inboard end view and the top view respectively of a head member after being severed from the extrusion depicted in FIG. 10 and after certain simple machining operations have been performed, FIG. 16 is a cross-section of the apparatus depicted in FIG. 14 as viewed along section line 16—16 thereof, FIGS. 17 and 18 are side views and end views respectively of the plunger of the pump.

DESCRIPTION OF THE PREFERRED EMBODIMENT

Figure 1:
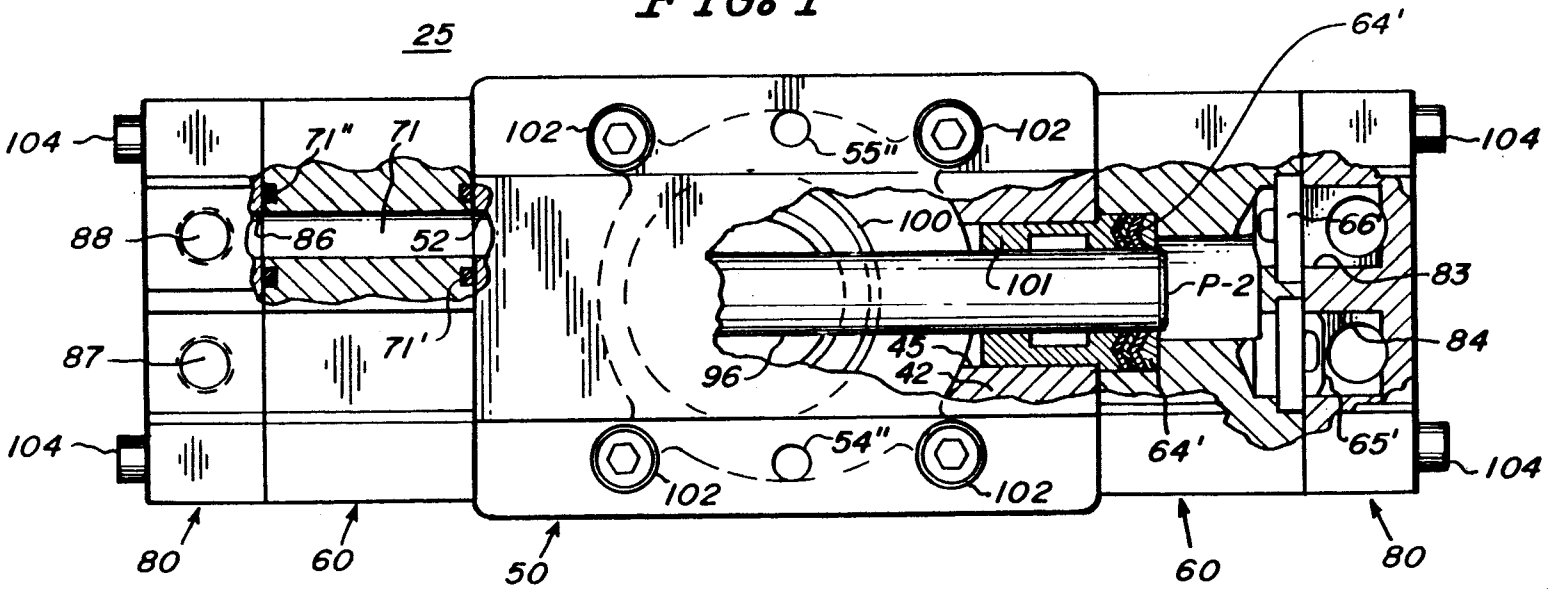
FIG. 1 is a top view, partly in section, of the assembled pump.
Figure 2:
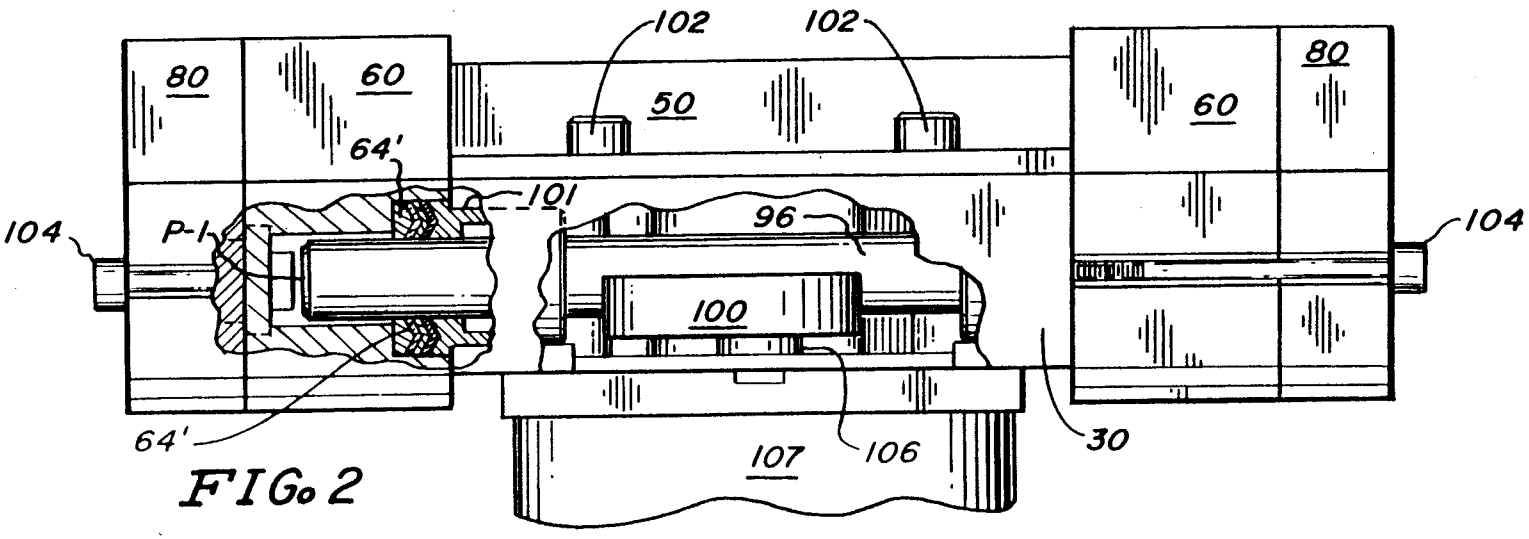
FIG. 2 is a side view of the apparatus shown in FIG. 1, and includes a showing of a motor means including an output shaft and crank means on the end thereof.
Figure 3:
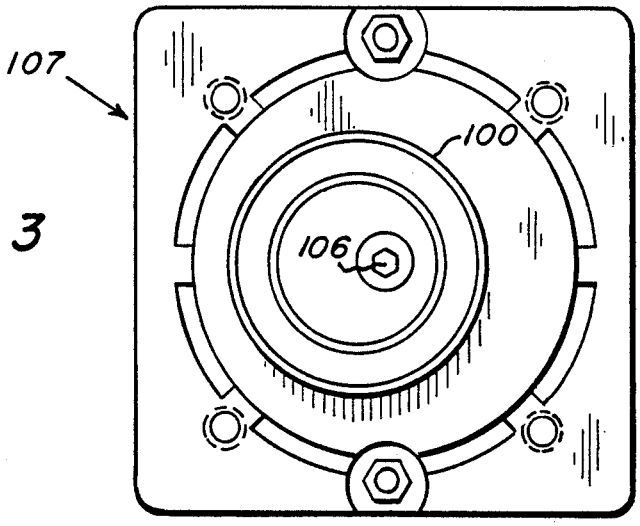
FIG. 3 is an end view of the motor means of FIG. 2.

The preferred embodiment of our invention is disclosed in the drawings. In FIGS. 1 and 2 the reference numeral 25 is used to designate the entire improved pump.

Figure 4:
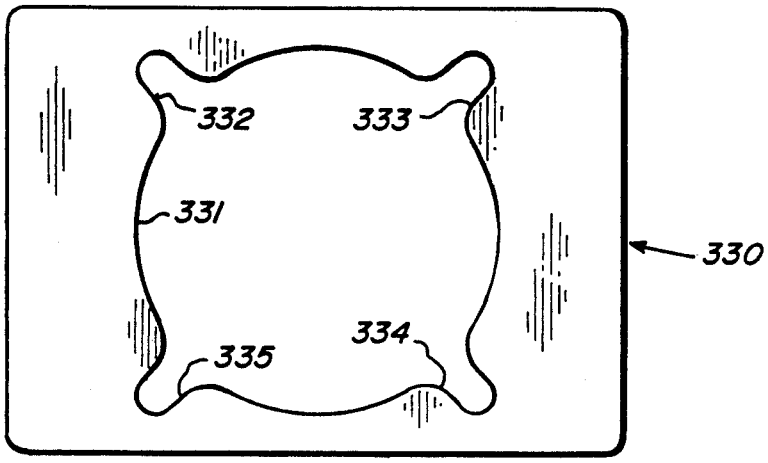
FIG. 4 is an end view of a crankcase extrusion.
Figure 5:
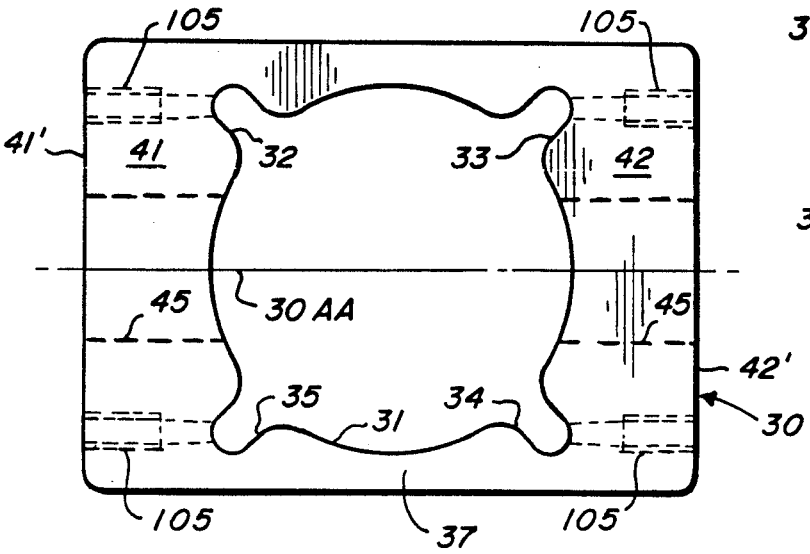
FIG. 5 is an end view or top view of a crankcase body after the same has been "sliced", i.e., cut from the crankcase extrusion depicted in FIG. 4 and also following certain simple machining operations.
Figure 6:
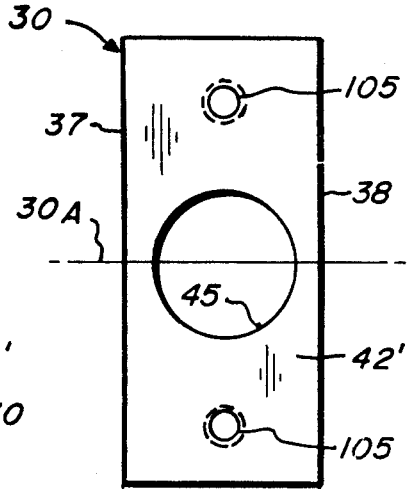
FIG. 6 is an end view of the crankcase.

The pump comprises a flat unitary rectangularly shaped crankcase body 30 shown in detail in FIGS. 5 and 6. As indicated, the crankcase body 30 is a "slice" of an extrusion 330 depicted in FIG. 4, this figure showing an end view of the extrusion as it is extruded from conventional extrusion apparatus, not shown. Our use of the term "slice" will be understood by those skilled in the art to cover, generically, all procedures (such as milling, sawing and grinding, for example) for cutting off a longitudinal section of an extrusion at a preselected length. The extruded material may be any appropriate material such as aluminum alloy; one that has been found to be satisfactory is 6061 aluminum. The extrusion 330 comprises a generally rectangular external shape with rounded corners and having, as extruded, a central, generally circular recess 331 which corresponds to crank case opening 31 of the crankcase member depicted in FIG. 5. Further, as extruded, the opening 331 has four equally spaced radially extending recesses 332, 333, 334 and 335, the corresponding recesses in the member shown in FIG. 5 being respectively identified by reference numerals 32, 33, 34 and 35.

The crankcase body 30 further comprises spaced apart planar and parallel top and bottom surfaces 37 and 38 (see FIG. 6), and first and second spaced apart end portions 41 and 42 shown in FIG. 5. The end portions 41 and 42 have parallel and planar end surfaces 41' and 42' which are normal to and which join said top and bottom surfaces 37 and 38. A crankcase axis 30A is shown in FIG. 6; it is that axis passing through the center of opening 31 of body 30 and perpendicular to the plane of the paper of FIG. 5.

A centrally positioned bore 45 is provided, by machining, in each of the end portions 41 and 42, said bores being aligned to define a plunger axis 30AA which is normal to the crankcase axis 30A and to the first and second end surfaces 41' and 42'. In each end 41' and 42' of body 30 are provided, by simple machining, a pair of spaced apart threaded recesses 105 used for assembly of the pump as described below.

Figure 7:
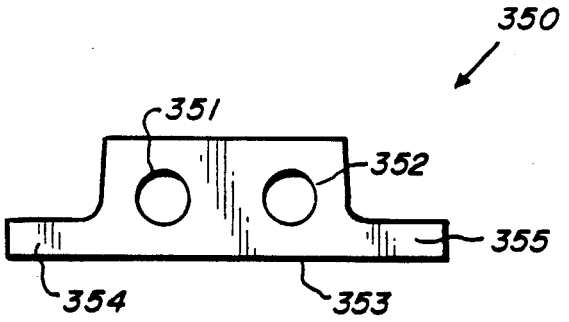
FIG. 7 is an end view of a manifold extrusion.
Figure 8:
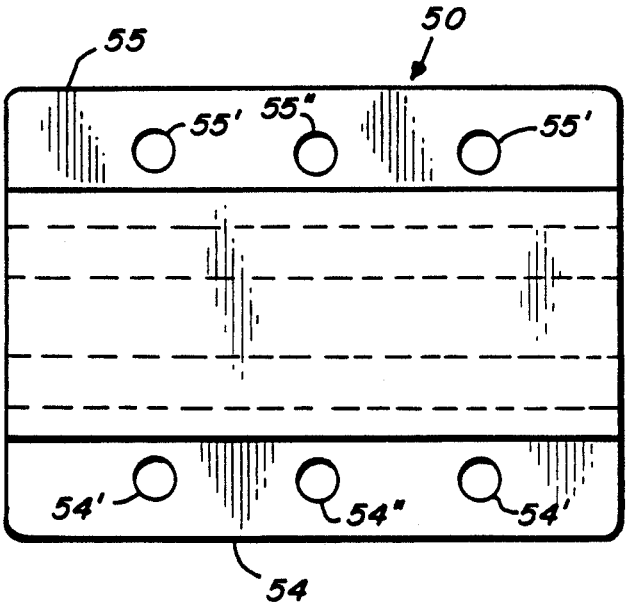
FIGS. 8 and 9 are top and end views respectively of the manifold after being sliced from the extrusion and after certain simple machining operations have been performed.
Figure 9:
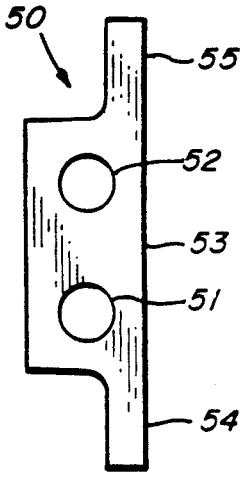

A manifold member is designated generally in FIGS. 8 and 9 by reference numeral 50 and is fashioned from an extrusion designated generally by the reference numeral 350 depicted in FIG. 7. It will be noted from FIG. 7 that the extrusion 350 includes a pair of spaced apart manifold ports 351 and 352. The manifold extrusion 350 is further characterized by having a flat bottom surface 353 and oppositely disposed edge portions 354 and 355; it may also be made of 6061 aluminum.

The manifold member is sliced or cut from the extrusion 350 at a preselected longitudinal length as depicted in FIG. 8 and the four corners are rounded as shown in FIG. 8. The resulting unitary manifold is thus provided with integral manifold ports 51 and 52, shown best in FIG. 9 and with the planar bottom surface 53 and the two oppositely disposed ends 54 and 55.

A subsequent machining operation provides holes 54', 55', 54'' and 55'' in ends 54 and 55 respectively as shown best in FIG. 8; holes 54', 55' are used to provide a partial means for the final assembly of the pump and the attachment thereto to the motor means, as will be described in further detail below. Holes 54'' and 55'' are drain holes for any leakage fluid as will be explained below.

The head and stuffing box extrusion depicted in FIG. 10 is identified by the very general reference numeral 360/380 since "slices" from the same extrusion is used for fabrication of the stuffing box 60 depicted in FIGS. 11–13 and the head 80 depicted in FIGS. 14–16. This extrusion also can be made from any appropriate material; we use 6061 aluminum in this preferred embodiment.

The extrusion 360/380 has a generally square or rectangular shape, as viewed in FIG. 10, comprising a top surface A, a bottom surface B and side surfaces C and D. The sides C and D are further characterized by having shoulders or projections thereof C' and D' with longitudinally extending bores therein C'' and D'' respectively. Bores C'' and D'' may be open, as shown in the drawing, or closed.

The pump comprises two stuffing box members, each identical to the apparatus shown in FIGS.11–13. The stuffing box member 60 is, as idicated, also a "slice" from the extrusion of FIG. 10 and thus comprises a unitary block having space apart planar and parallel inboard and outboard ends, i.e., surfaces 61 and 62, as shown best in FIG. 13. A plunger receiving recess 63 is machined into the inboard end 61; a concentric counter bore 64 is provided for a plunger gasketing or packing means 64' shown in FIG. 1. The gasketing or packing means 64' depicted is of the Chevron type. Other seals may also be used.

First and second pump port recesses 65 and 66 are provided in and normal to the outboard end 62 and extend partially through the stuffing box (see FIG. 13), thereby becoming directly hydraulically connected to the plunger receiving recess 63.

First and second check valve means 65' and 66' (see FIG. 1) are adapted to be respectively and reversedly positioned in said first and second pump port recesses 65 and 66 so that said first check valve means 65' will admit fluid flow from said plunger receiving recess out though said outboard end so that said second check valve means 66' will admit fluid flow from said outboard end into said plunger receiving recess.

Also provided in each stuffing box member 60 are a pair of first and second spaced apart parallel stuffing box bores 70 and 71 extending therethrough between said inboard and outboard ends and normal thereto and having the same approximate cross-section and mutual spacing as said first and second manifold ports 51 and 52. "O" ring receiving recesses 70' and 71' are provided in surfaces 61 and 62 concentric with bores 70 and 71 respectively and receive, respectively "O" rings 70'' and 71'' for sealing to be described below.

The pump requires two head memebers, each indentical to the apparatus depicted in FIGS. 14–16. As indicated, the head members 80 are made from "slices" of the same extrusion as that used to fabricate the stuffing box members, i.e., the extrusion depicted in FIG. 10. In FIG. 14, for example, it will be noted that the designators A,B,C,D,C'' and D'' have been used to show correspondence with the same surfaces and bores as depicted FIG. 10 for the extrusion.

Thus, each head member 80 is a slice from the extrusion of FIG. 10 providing an inboard surface 81 and an outboard surface 82. Stated otherwise, each head member 80 comprises a unitary block having spaced apart inboard and outboard ends 81 and 82, said inboard end having a planar surface and, from a practical standpoint, the outboard surface 82 also will be planar since the head members are slices from the extrusion.

Each head member 80 comprises first and second spaced apart pump valve coacting recesses 83 and 84 which are in and normal to the inboard end 81 and have the same approximate cross-section and mutual spacing as the aforesaid first and second pump port recesses 65 and 66 of the stuffing box.

Each head member also has first and second spaced apart head recesses 85 and 86 in and normal to the inboard end 81 and having the same approximate cross-section and mutual spacing as said first and second manifold ports 51 and 52 and said fist and second stuffing box bores 70 and 71.

In addition, each head member has first and second inlet/oulet bore means 87 and 88 which extend from the top surface A partially through the member to connect with the bores or recesses 83 and 84, and 86, as shown best in FIGS. 14 and 16. Threaded portions 87'' and 88'' of the bore means are provided adjacent surface A to facilitate the connection of inlet and outlet conduit means.

The head members can be modified in a number of respects to match the intended end use. The width (or longitudinal length) can be increased to provide additional outlet and/or inlet ports. Also the ports can be shifted in a radial sense as required, e.g., top, bottom, side or some other selected radial angle.

FIG. 17 shows a plunger member 95 comprising a unitary cylindrical shaft 96. The shaft has a preselected longitudinal length with first and second plunger means P1 and P2 on the ends thereof. The actual plunger function is provided by the snug fit of the plunger shaft into the coacting plunger receiving recess 63 in the stuffing box. Thus, the ends P1 and P2 of the plunger member 95, when the same is reciprocated, provide an alternating pumping action, i.e., first at one end and then at the other end; hence the designator "double acting".

The midsection of shaft 96 is cut away, as shown clearly in FIG. 17 providing two shoulder-like surfaces 97 and 98, which are adapted to be engaged by a crank or cam means 100 connected to the end of a shaft 106 of driving motor means 107 shown in FIG. 2.

Referring now to FIGS. 1 and 2, portions have been cut away so as to show internal features. Generally the pump comprises the centrally positioned crank case 30. In FIG. 1, one of the bores 45 and end 42 of the crankcase body is shown; positioned within this bore is a bushing 101 adapted to support for smooth reciprocation the plunger shaft 96. At the outboard end of the bushing is the "V-shaped" or "Chevron" packing 64' which function to "seal off" the shaft from the pressure of the fluid being pumped. The manifold member 50 is mounted with its bottom flat surface 53 abutted against the top planar surface 37 of the crankcase body 30 and is held in position therewith by four socket head cap screws 102. The left hand portion of the apparatus depicted in FIG. 1 is cut away to show how the ports 52 (of the manifold 50), 71 (of the stuffing box 60), and 86 (of the head 80) all are in alignment. "O" rings 71'' are disposed in the recesses 71' so as to provide fluid tight joints between the stuffing box and the head (on the outboard surface) and the manifold (on the inboard surface).

Thus, as viewed in FIG. 1, at the left end of the assembled crankcase body and manifold 50, is first a stuffing box member 60 with the inboard surface of the stuffing box abutted against the crankcase body and manifold and with the outboard surface of the stuffing box abutted by the inboard surface of the head 80. A pair of socket head cap screws 104 pass through apertures C'' and D'' of 60 and 80 and screw into threaded recesses 105 in the crankcase body 30 (see FIG. 5).

The same arrangement is provided on the right hand side of the assembled crankcase body and manifold, as shown in FIG. 1, i.e., a stuffing box 60 abutted against the end surface 42' of the crankcase body and manifold and with a head member 80 abutted against the outboard surface 62 of the stuffing box 60, all elements being held firmly in position by socket head cap screws 104.

As indicated, our invention is applicable to both plunger and piston type pumps. The plunger type has heretofore been shown in FIGS. 1–18.

Figure 19:
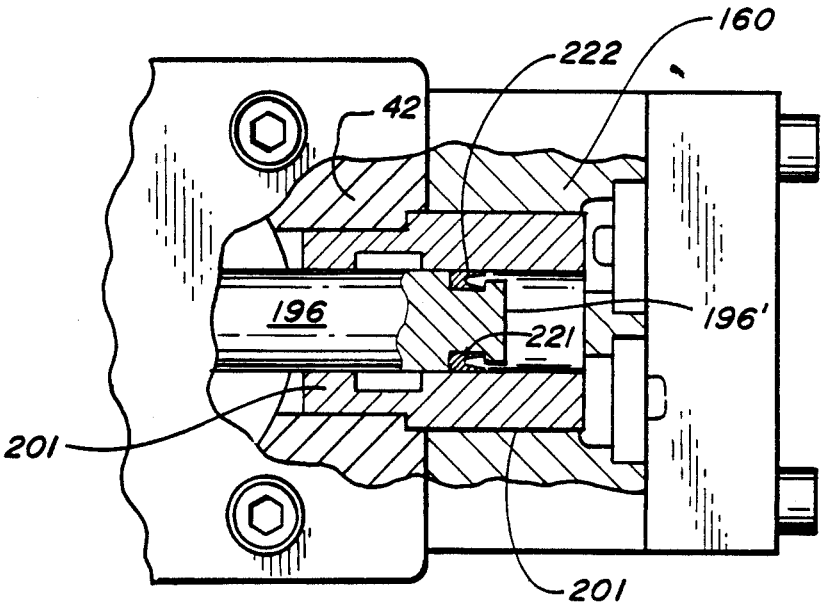
FIG. 19 is a view of a portion of a piston type pump.

FIG. 19 depicts one embodiment of a piston. The reference numeral 196 designates one end of a round shaft which can be generally the same as that depicted in FIG. 17 except for the below noted features. The end of shaft 196 is designated by reference numeral 196; adjacent thereto is a circumferential groove 221 in which is disposed a suitable seal means, a "U-cup" sealing element 222 being depicted. The shaft 196 is supported for reciprocation in a bushing 201 somewhat similar to bushing 101 except that the packing 101' has been deleted; its function is provided by the seal 222. In FIG. 19 the reference numerals 42 and 160 designate the crankcase body and (modified) stuffing box 60. Thus, the shaft 196 is adapted to be reciprocated by a means similar for the first embodiment of FIGS. 1–18 to provide a pumping action.

Figure 20:
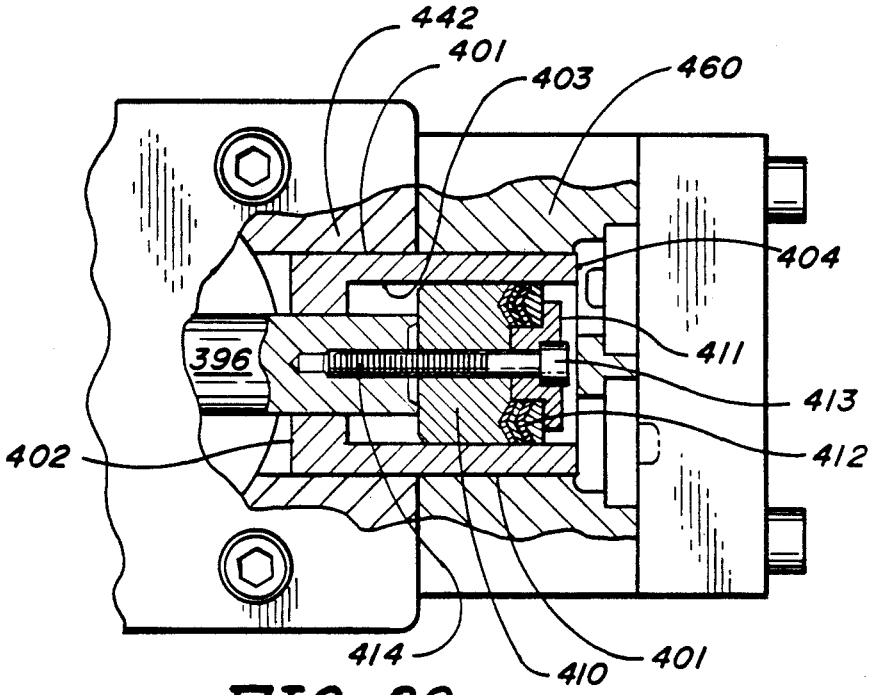
FIG. 20 is a view of a portion of another type of piston pump, the arrangements of FIGS. 19 and 20 being examples of pumps generically covered by our invention.

In FIG. 20 a shaft 396 is adapted to be reciprocated (as shaft 96) in a supporting bushing 401 having an inboard end 402 sized to closely fit the shaft 396. The remainder of bushing 401 is a cylindrical bore 403 of a larger inside diameter terminating at the outboard end 404. Positioned within bore 403 is a piston assembly comprising an inner seal support 410, an outer support or clamping plate 411, and a V or Chevron type seal 412 clamped therebetween, the clamping being provided by the force from a clamping screw means 413 having a head engaging 411 and a threaded means engaging a suitable matching threaded recess 414 centrally located on the outboard end of shaft 396.

In the appended claims the word "plunger" is intended in the generic sense to cover the several embodiments shown in the drawings and herein described.

As indicated above, the holes 54'' and 55'' are provided as a drain means for the crankcase space. Normally there is no hydraulic fluid, e.g., water, which is being pumped by the pump which enters the crankcase. However, the seals 64'' may, over a period of time and/or use, wear and thus permit leaking of the pumped fluid axially along the plunger shaft into the crankcase. To avoid any tendency of the fluid to come into the contact with electrical elements of the motor means 107, the leaked fluid will, instead, drip out of the holes 54'' and 55''; such dripping will signal to the operator that a maintenance operation may be appropriate.

Maintenance is quick, simple, and requires only, as aforesaid, a simple single tool, e.g., a hex-head wrench. Thus, simple repairs or adjustments may be made in the field.

It is to be understood that the embodiments of our invention shown are only for the purpose of illustration and that our invention is limited solely by the scope of the appended claims.

We claim as our invention:

1. A double acting simplex plunger pump comprising:

(1) a flat unitary rectangularly shaped crankcase body having (i) spaced apart planar and parallel top and bottom surfaces, (ii) first and second spaced apart end portions having parallel planar end surfaces normal to and joining said top and bottom surfaces, (iii) a crankcase space being centrally located in said body and extending therethrough along a crankcase axis normal to said top and bottom surfaces and, (iv) a bore in each of said first and second end portions, said bores being aligned to define a plunger axis normal to said crankcase axis and to said first and second end surfaces;

(2) a unitary manifold member having a flat rectangular shape with a longitudinal axis, a bottom flat surface and first and second spaced apart manifold ports extending therethrough from a first end to a second end and being mutually parallel to said longitudinal axis, said manifold member being connected to said crankcase body so that said longitudinal axis is parallel to said plunger axis and said manifold bottom flat surface is abutted against said top surface of said crankcase body, said manifold member having a longitudinal length equal to the length of said crankcase body between said planar end surfaces thereof;

(3) first and second stuffing box members each comprising (i) a unitary block having spaced apart planar and parallel inboard and outboard ends, (ii) a plunger receiving recess in and normal to said inboard end, (iii) first and second pump port recesses in and normal to said outboard end and directly connected to said plunger receiving recess, (iv) first and second check valve means respectively and reversely positioned in said first and second pump port recesses so that said first check valve means will admit fluid flow from said plunger receiving recess out through said outboard end and so that said second check valve means will admit fluid flow from said outboard end into said plunger receiving recess, and (v) first and second spaced apart parallel stuffing box bores extending therethrough between said inboard and outboard ends and normal thereto and having the same approximate cross-section and mutual spacing as said first and second manifold ports;

(4) first and second head members each comprising (i) a unitary block having spaced apart inboard and outboard ends, said inboard end having a planar surface, (ii) first and second spaced apart pump valve coacting recesses in and normal to said inboard end and having the same approximate cross-section and mutual spacing as said first and second pump port recesses, (iii) first and second spaced apart head recesses in and normal to said inboard end and having the same approximate cross-section and mutual spacing as said first and second maniforld ports and said first and second stuffing box bores, and (iv) first and second inlet/outlet bore means in said head member block respectively separately interconnecting said first and second pump valve coacting recesses respectively with said first and second head recesses;

(5) a plunger member comprising a unitary cylindrical shaft having a preselected longitudinal length, first and second plunger means on the ends thereof, and a centrally located crank engaging section; and (6) means connecting together (i) said crankcase and assembled manifold member as aforesaid, (ii) said stuffing box members, (iii) said head members, and (iv) said plunger member whereby:

(a) said stuffing box inboard ends are respectively abutted against said first and second end surfaces of said crankcase body with said plunger receiving recess thereof aligned with said plunger axis of said crankcase body and with said first and second stuffing box bores being respectively positioned in register with said first and second manifold ports, (b) said inboard ends of said first and second head members are respectively abutted against said outboard ends of said first and second stuffing box members, with said first and second pump valve coacting recesses being respectively positioned in register with said first and second pump port recesses, and with said first and second head recesses being respectively positioned in register with said first and second stuffing box bores, and (c) said plunger member being positioned within said crankcase body for reciprocation relative thereto along said plunger axis, said plunger ends coacting alternately with said pump port recesses of said stuffing box members to provide a pumping action.

2. Apparatus of claim 1 being further characterized by including:

(1) motor means including an output rotatable shaft, (2) crank means on an end of said output shaft, and (3) means connecting said motor means to said bottom surface of said crankcase body and whereby said crank means is operatively engaged with said centrally located crank engaging section of said plunger shaft.

3. Apparatus of claim 1 further characterized by said crankcase body including said crankcase space being a slice of an extrusion.

4. Apparatus of claim 1 further characterized by said stuffing box members being slices of an extrusion.

5. Apparatus of claim 1 further characterized by said head members being slices of an extrusion.

6. Apparatus of claim 1 further characterized by said stuffing box members and said head members being slices of the same extrusion.

7. Apparatus of claim 1 further characterized by said manifold member including said manifold ports being a slice of an extrusion.

8. Apparatus of claim 1 further characterized by all of the following being respectively made from slices of a respective extrusion:

(1) said crankcase body including said crankcase space, (2) said stuffing box members, (3) said head members, and (4) said manifold members.

9. Apparatus of claim 8 further characterized by said stuffing box members and said head members being slices of the same extrusion.

10. A double acting simplex plunger pump comprising:

(1) a unitary crankcase body having (i) spaced first and second mounting surfaces, (ii) first and second spaced apart end portions having parallel planar end surfaces normal to and joining said first and second mounting surfaces, (iii) a crankcase spaced being centrally located in said body and, (iv) a bore in each of said first and second end portions, said bores being aligned to define a plunger axis normal to said first and second end surfaces;

(2) a unitary manifold member having a longitudinal axis, a flat mounting surface and first and second spaced apart manifold ports extending therethrough from a first end to a second end and being mutually parallel to said longitudinal axis, said manifold member being adapted to be connected to said crankcase body so that said longitudinal axis is parallel to said plunger axis and said manifold mounting surface is abutted against one of said mounting surfaces of said crankcase body, (3) first and second stuffing box members each comprising (i) a unitary block having spaced apart planar and parallel inboard and outboard ends, (ii) a plunger receiving recess in and normal to said inboard end, (iii) first and second pump port recesses in and normal to said outboard end and directly connected to said plunger receiving recess, (iv) first and second check valve means respectively and reversely positioned in said first and second pump port recesses so that said first check valve means will admit fluid flow from said plunger receiving recess out through said outboard end and so that said second check valve means will admit fluid flow from said outboard end into said plunger receiving recess, and (v) first and second spaced apart parallel stuffing box bores extending therethrough between said inboard and outboard ends and normal thereto and having the same approximate cross-section and mutual spacing as said first and second manifold ports;

(4) first and second head members each comprising (i) a unitary block having spaced apart inboard and outboard ends, said inboard end having a planar surface, (ii) first and second spaced apart pump valve coacting recesses in and normal to said inboard end and having the same approximate cross-section and mutual spacing as said first and second pump port recesses, (iii) first and second spaced apart head recesses in and normal to said inboard end and having the same approximate cross-section and mutual spacing as said first and second manifold ports and said first and second stuffing box bores, and (iv) first and second inlet/outlet bore means in said head member block respectively separately interconnecting said first and second pump valve coacting recesses respectively with said first and second head recesses;

(5) a plunger member comprising a unitary cylindrical shaft having a preselected longitudinal length, first and second plunger means on the ends thereof, and a centrally located crank engaging section; and (6) means connecting together (i) said crankcase and assembled manifold member as aforesaid, (ii) said stuffing box members, (iii) said head members, and (iv) said plunger member whereby:

(a) said stuffing box inboard ends are respectively abutted against said first and second end surfaces of said crankcase body with said plunger receiving recess thereof aligned with said plunger axis of said crankcase body and with said first and second stuffing box bores being respectively positioned in register with said first and second manifold ports, (b) said inboard ends of said first and second head members are respectively abutted against said outboard ends of said first and second stuffing box members, with said first and second pump valve coacting recesses being respectively positioned in register with said first and second pump port recesses, and with said first and second head recesses being respectively positioned in register with said first and second stuffing box bores, and (c) said plunger member being positioned within said crankcase body for reciprocation relative thereto along said plunger axis, said plunger ends coacting alternately with said pump port recesses of said stuffing box members to provide a pumping action.

11. Apparatus of claim 10 being further characterized by including:

(1) motor means including an output rotatable shaft, (2) crank means on an end of said output shaft, and (3) means connecting said motor means to the other of said mounting surfaces of said crankcase body and whereby said crank means is operatively engaged with said centrally located crank engaging section of said plunger shaft.

12. Apparatus of claim 10 further characterized by said crankcase body including said crankcase space being a slice of an extrusion.

13. Apparatus of claim 10 further characterized by said stuffing box members being slices of an extrusion.

14. Apparatus of claim 10 further characterized by said head members being slices of an extrusion.

15. Apparatus of claim 10 further characterized by said stuffing box members and said head members being slices of the same extrusion.

16. Apparatus of claim 10 further characterized by said manifold member including said manifold ports being a slice of an extrusion.

17. Apparatus of claim 10 further characterized by all of the following being respectively made from slices of a respective extrusion:

(1) said crankcase body including said crankcase space, (2) said stuffing box members, (3) said head members, and (4) said manifold members.

18. Apparatus of claim 17 further characterized by said stuffing box members and said head members being slices of the same extrusion.

* * * * *